US008711054B2

(12) United States Patent
Wu et al.

(10) Patent No.: US 8,711,054 B2
(45) Date of Patent: Apr. 29, 2014

(54) ELECTRONIC DEVICE WITH EMBEDDED ANTENNA

(71) Applicant: Ralink Technology Corp., Hsinchu County (TW)

(72) Inventors: Min-Chung Wu, Taoyuan County (TW); Shao-Chin Lo, Miaoli County (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 0 days.

(21) Appl. No.: 13/961,906

(22) Filed: Aug. 8, 2013

(65) Prior Publication Data

US 2013/0321242 A1 Dec. 5, 2013

Related U.S. Application Data

(62) Division of application No. 12/894,191, filed on Sep. 30, 2010, now Pat. No. 8,531,348.

(30) Foreign Application Priority Data

Oct. 6, 2009 (TW) ..... 98133844 A
Nov. 26, 2009 (TW) ..... 98140322 A

(51) Int. Cl.
*H01Q 1/50* (2006.01)
*H01Q 1/40* (2006.01)

(52) U.S. Cl.
USPC ..... 343/906; 343/702; 343/873

(58) Field of Classification Search
None
See application file for complete search history.

(56) References Cited

U.S. PATENT DOCUMENTS

| | | | | |
|---|---|---|---|---|
| 5,537,123 | A | 7/1996 | Mandai | |
| 5,912,647 | A | 6/1999 | Tsuru | |
| 6,140,971 | A | 10/2000 | Kitamura | |
| 6,414,641 | B1 * | 7/2002 | Carlson et al. | 343/702 |
| 6,774,849 | B2 | 8/2004 | Umehara | |
| 6,842,142 | B2 | 1/2005 | Takesako | |
| 7,268,745 | B2 * | 9/2007 | Yang et al. | 343/895 |
| 7,839,335 | B2 * | 11/2010 | Chen | 343/700 MS |
| 8,154,470 | B2 | 4/2012 | Chang | |
| 8,217,853 | B2 | 7/2012 | Tai | |
| 2002/0000938 | A1 | 1/2002 | Hoashi | |
| 2006/0097949 | A1 * | 5/2006 | Luebke et al. | 343/873 |
| 2008/0153329 | A1 | 6/2008 | Lin | |
| 2008/0231519 | A1 * | 9/2008 | Yang et al. | 343/702 |
| 2009/0167631 | A1 | 7/2009 | Tai | |
| 2010/0134382 | A1 * | 6/2010 | Liu et al. | 343/906 |
| 2010/0164835 | A1 * | 7/2010 | Tai et al. | 343/906 |
| 2010/0315297 | A1 * | 12/2010 | Wu et al. | 343/702 |
| 2011/0095963 | A1 * | 4/2011 | Wu et al. | 343/906 |
| 2011/0159815 | A1 * | 6/2011 | Wu et al. | 455/41.2 |

FOREIGN PATENT DOCUMENTS

| | | | |
|---|---|---|---|
| CN | 201060951 | Y | 5/2008 |
| CN | 201156584 | Y | 11/2008 |
| TW | 200828668 | | 7/2008 |
| WO | 0161781 | A1 | 8/2001 |

* cited by examiner

*Primary Examiner* — Trinh Dinh
(74) *Attorney, Agent, or Firm* — Winston Hsu; Scott Margo

(57) ABSTRACT

An electronic device with an embedded three-dimensional antenna is disclosed. The electronic device includes a printed circuit board (PCB) and an embedded three-dimensional antenna. The embedded three-dimensional antenna includes a radiation element and a connection element. The connection element includes a first connection part and a second connection part. The first and second connection parts are coupled to the PCB, and utilized for transferring signals of the embedded three-dimensional antenna to the PCB. The first and second connection parts further clamp the PCB to attach the embedded three-dimensional antenna on the PCB.

8 Claims, 17 Drawing Sheets

ELECTRONIC DEVICE WITH EMBEDDED ANTENNA

CROSS REFERENCE TO RELATED APPLICATIONS

This application is a division of U.S. Pat. No. 8,531,348 filed on Sep. 30, 2010 which claims the benefit of TAIWAN Application No. 098133844 filed on Oct. 6, 2009, and TAIWAN Application No. 098140322 filed on Nov. 26, 2009, the contents of which are incorporated herein.

BACKGROUND OF THE INVENTION

1. Field of the Invention

The present invention relates to an electronic device with an embedded antenna, and more particularly, to an electronic device utilizing a clamping mechanism formed by an embedded three-dimensional antenna itself, to attach the antenna on a Printed Circuit Board (PCB).

2. Description of the Prior Art

In modern life, various wireless communication networks have become essential for people to communicate and transmit information. Wireless communication devices, such as cell phones, personal digital assistants (PDAs) and wireless USB dongles, are thus widely used in daily life, and are developed toward compact sizes. Manufacture processes of the wireless communication devices are also simplified to reduce costs and enhance yields. An antenna is a large size element in the wireless communication device, other than a Printed Circuit Board (PCB). The antenna is commonly an embedded antenna formed by a sheet metal, such that appearance of the wireless communication device can be designed with more flexibility while portability can also be met.

Electronic elements are assembled with a PCB through automatic Surface Mount Technology (SMT). However, conventional embedded antennas do not belong to surface mount elements, and need to be assembled through extra assembly process, instead of the SMT. There are two assembly methods for the conventional embedded antennas: one is manually soldering the antenna on the PCB after the SMT process; and the other is utilizing elastic sheet metals of the PCB to contact the antenna formed on an exterior of the wireless communication device without the soldering process. The aforementioned two methods for assembling the embedded antenna require high cost, and tend to have unstable antenna characteristics due to man-made errors.

As can be seen from the above, the prior art needs extra assembly processes to attach the embedded three-dimensional antenna on the PCB, in addition to the automatic assembly processes, such as SMT setting and reflow. As a result, production cost of the wireless communication device is increased. Therefore, the embedded antenna needs to be improved to meet requirement of compact size and high yield.

SUMMARY OF THE INVENTION

It is therefore an objective of the present invention to provide an electronic device with an embedded antenna.

The present invention discloses an electronic device with an embedded three-dimensional antenna. The electronic device includes a printed circuit board (PCB) and an embedded three-dimensional antenna. The embedded three-dimensional antenna includes a radiation element and a connection element. The connection element includes a first connection part and a second connection part. The first and second connection parts are respectively coupled to the PCB, and are utilized for transferring signals of the embedded three-dimensional antenna to the PCB. The first and second connection parts further form a clamping mechanism for clamping both sides of the PCB such that the embedded three-dimensional antenna is attached on the PCB.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
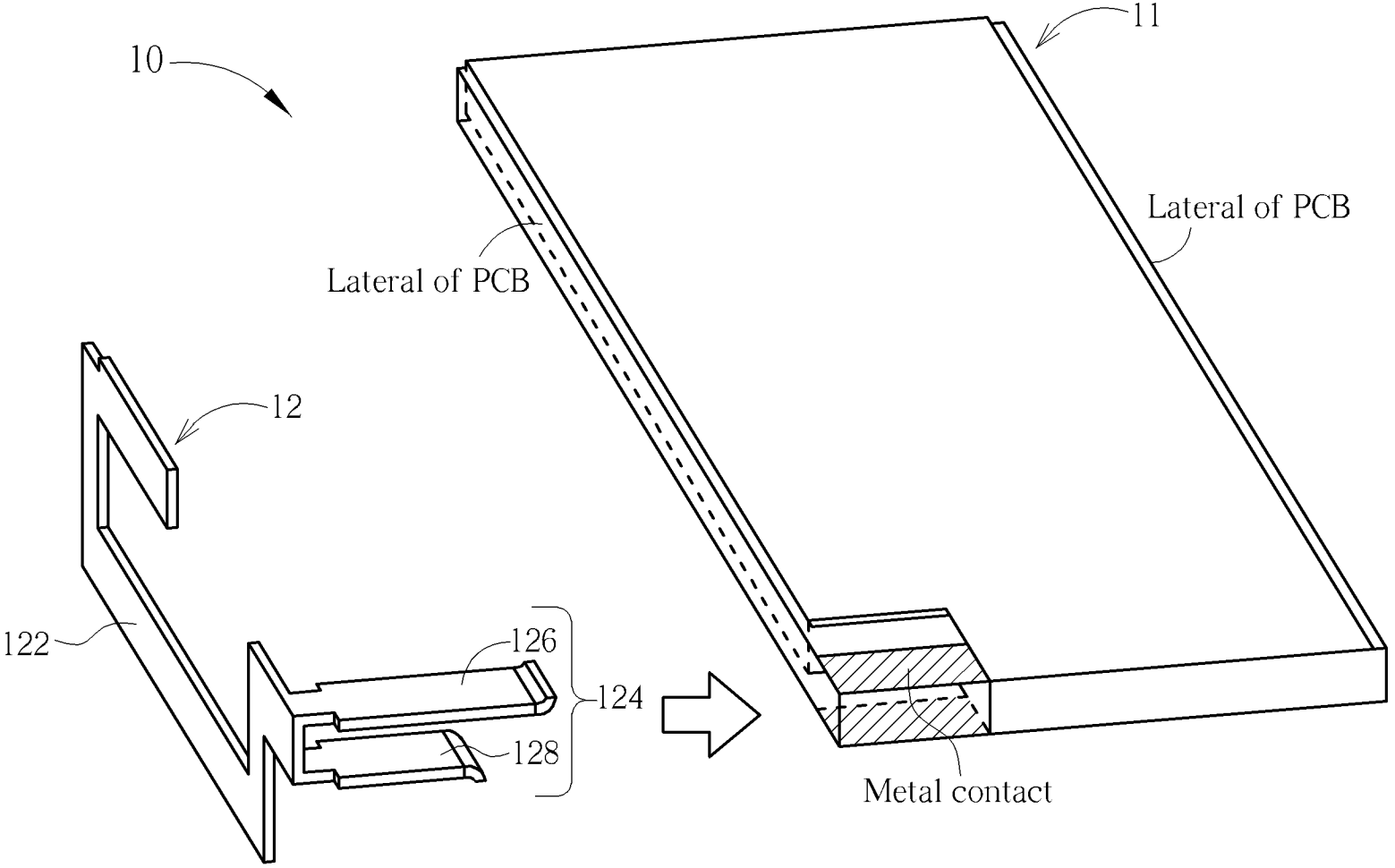
FIG. 1 is an illustration of an electronic device with an embedded three-dimensional antenna according to the present invention.

Please refer to FIG. 1, which is an illustration of an electronic device 10 with an embedded three-dimensional antenna according to the present invention. The electronic device 10 includes a printed circuit board (PCB) 11 and an embedded three-dimensional antenna 12. The embedded three-dimensional antenna 12 includes a radiation element 122 and a connection element 124. The radiation element 122 is a bended sheet metal and is disposed on a lateral of the PCB 11. The connection element 124 is formed at one end of the radiation element 122, and includes connection parts 126 and 128. The connection parts 126 and 128 are respectively coupled to the PCB 11, and are utilized for transferring signals of the embedded three-dimensional antenna 12 to the PCB 11. The connection parts 126 and 128 further form a clamping mechanism for clamping both sides of the PCB 11 such that the embedded three-dimensional antenna 12 is attached on the PCB 11.

In other words, the connection parts 126 and 128 of the embedded three-dimensional antenna 12 not only connects to the PCB 11 for transferring signals of the antenna, such as a feeding signal and a grounding signal of the antenna, to the PCB 11, but also forms the clamping mechanism for clamping both sides of the PCB 11 such that the embedded three-dimensional antenna 12 can be attached on the PCB 11. Thus, assembly of the embedded three-dimensional antenna 12 can be integrated with automatic assembly processes, such as a surface mount technology (SMT) process and a reflow soldering process, so as to simplify the assembly process of the electronic device 10 and reduce the production cost.

Figure 2:
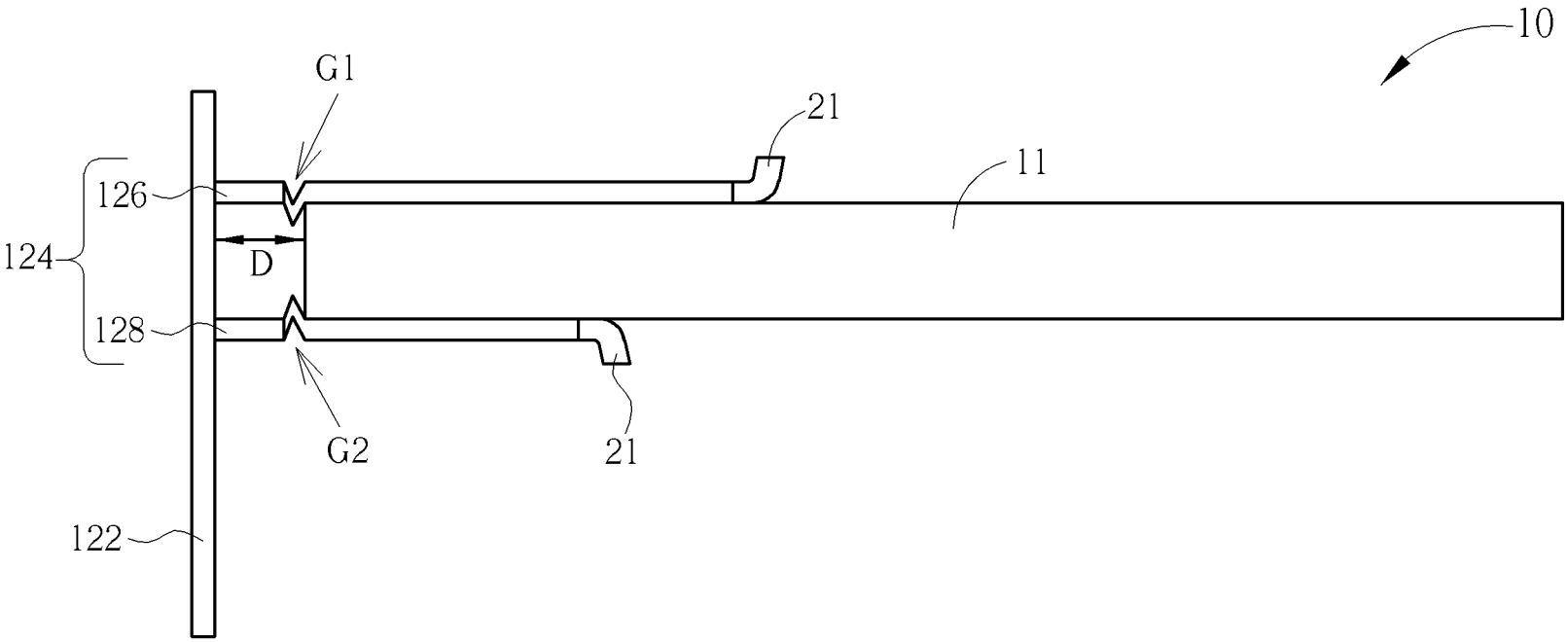
FIG. 2 is an illustration of a side view of the electronic device in FIG. 1.

Please refer to FIG. 2, which is an illustration of a side view of the electronic device 10. As known by those skilled in the art, the radiation element 122 needs to be kept an attached distance from the PCB 11 such that the antenna has broader bandwidth and better efficiency. Under such condition, the connection parts 126 and 128 further have notches G1 and G2, respectively, for fixing a distance D from the radiation element 122 to the PCB 11 when the three-dimensional antenna 12 is assembled with the PCB 11. Besides, tail ends of the connection parts 126 and 128 can further include an outward warped mechanism 21, to make the assemble of the antenna and the PCB more simple and accurate. As for the assembly process of the antenna and the PCB, please refer to the following description.

First, metal contacts are reserved on the PCB 11 for connecting with the connection parts 126 and 128, i.e. a feeding terminal and a grounding terminal of the three-dimensional antenna 12. Then, after the PCB 11 is brushed with solder paste, the connection element 124 clamps the three-dimensional antenna 12 to the metal contacts having solder paste. Since the antenna 12 is designed on the lateral of the PCB 11, the upper and lower sides of the PCB 11 can still be utilized for performing auto-insertion of other components. Finally, the PCB 11 including the three-dimensional antenna 12 is passed through a reflow oven to complete the automatic assembly process. As a result, no manual processes are needed to assemble the antenna with the PCB, so that the production cost can be saved.

Note that, the size of the metal contacts, which are used to couple the feeding terminal and the grounding terminal of the antenna, not only relates to antenna performance but also needs mechanical consideration. The mechanism design of the antenna must be able to clamp the PCB and support the weight of the whole antenna, as well as keep the antenna a proper distance from the lateral of the PCB.

Figure 3:
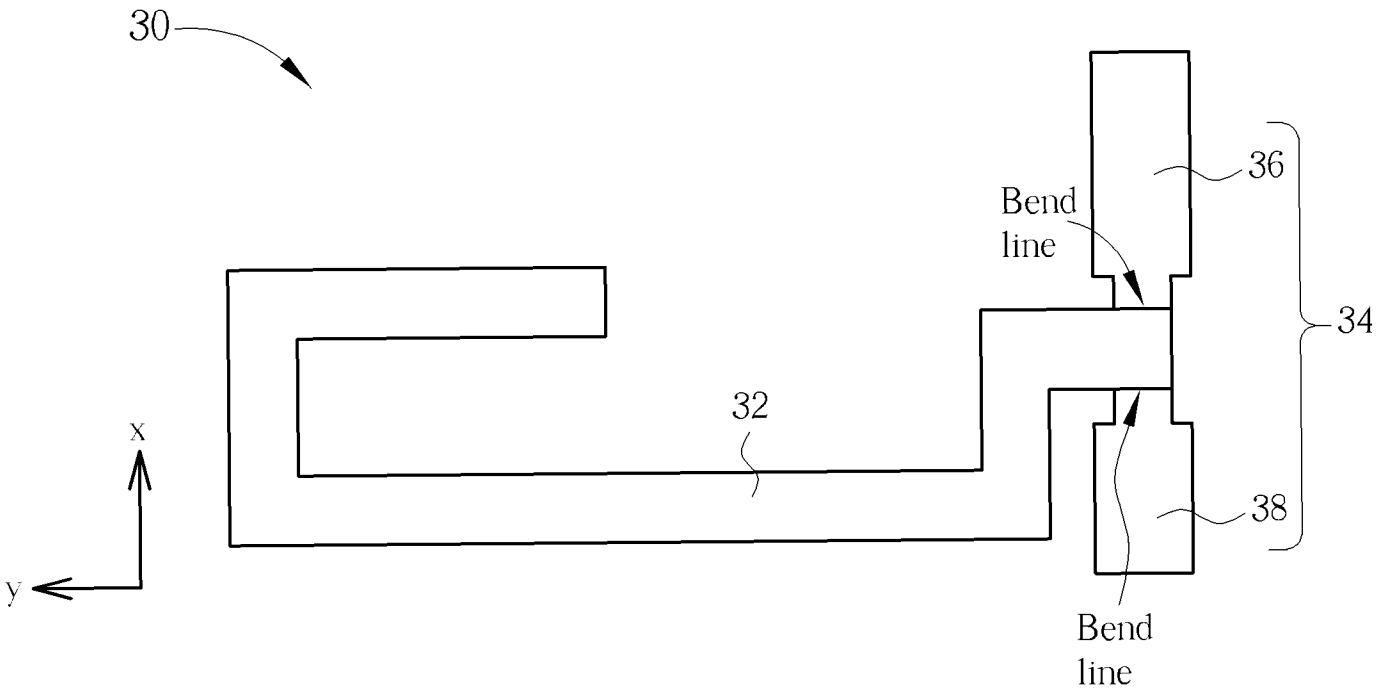
FIG. 3 to FIG. 5 are illustrations of an embedded three-dimensional antenna according to an embodiment of the present invention.
Figure 4:
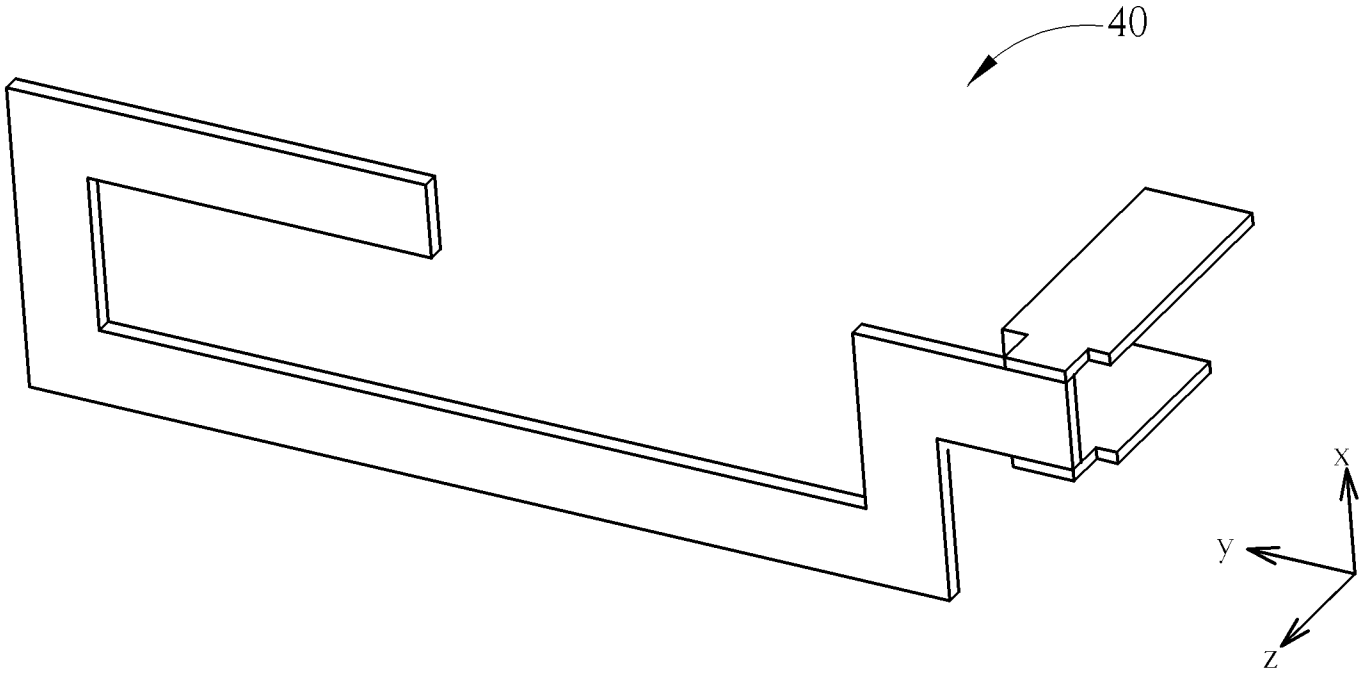
Figure 5:
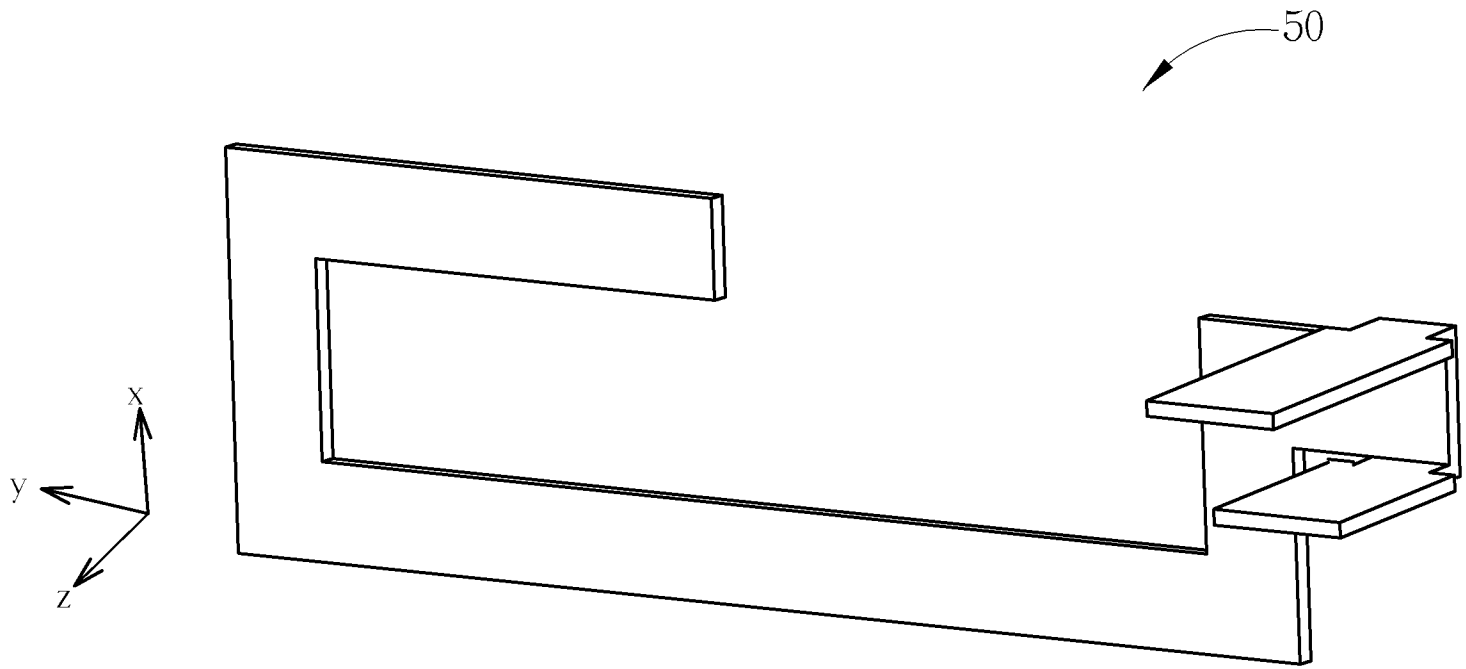

Please refer to FIG. 3, which is an illustration of an embedded three-dimensional antenna 30 according to an embodiment of the present invention. The embedded three-dimensional antenna 30 is utilized for realizing the embedded three-dimensional antenna 12 in FIG. 1. As shown in FIG. 3, the embedded three-dimensional antenna 30 is formed by a single sheet metal, and is divided into a radiation element 32 and a connection element 34 by two bend lines. The connection parts 36 and 38 can be bended toward +Z direction or −Z direction along the bend lines to form a clip-like clamping element. If the connection parts 36 and 38 are bended 90 degree toward −Z direction, an embedded three-dimensional antenna 40 as shown in FIG. 4 is formed; if the connection parts 36 and 38 are bended 90 degree toward +Z direction, then an embedded three-dimensional antenna 50 as shown in FIG. 5 is formed. Therefore, the metal mechanisms made from a same die cut can form two symmetric antennas clamping on the PCB. Such variation also belongs to the scope of the present invention.

Figure 6:
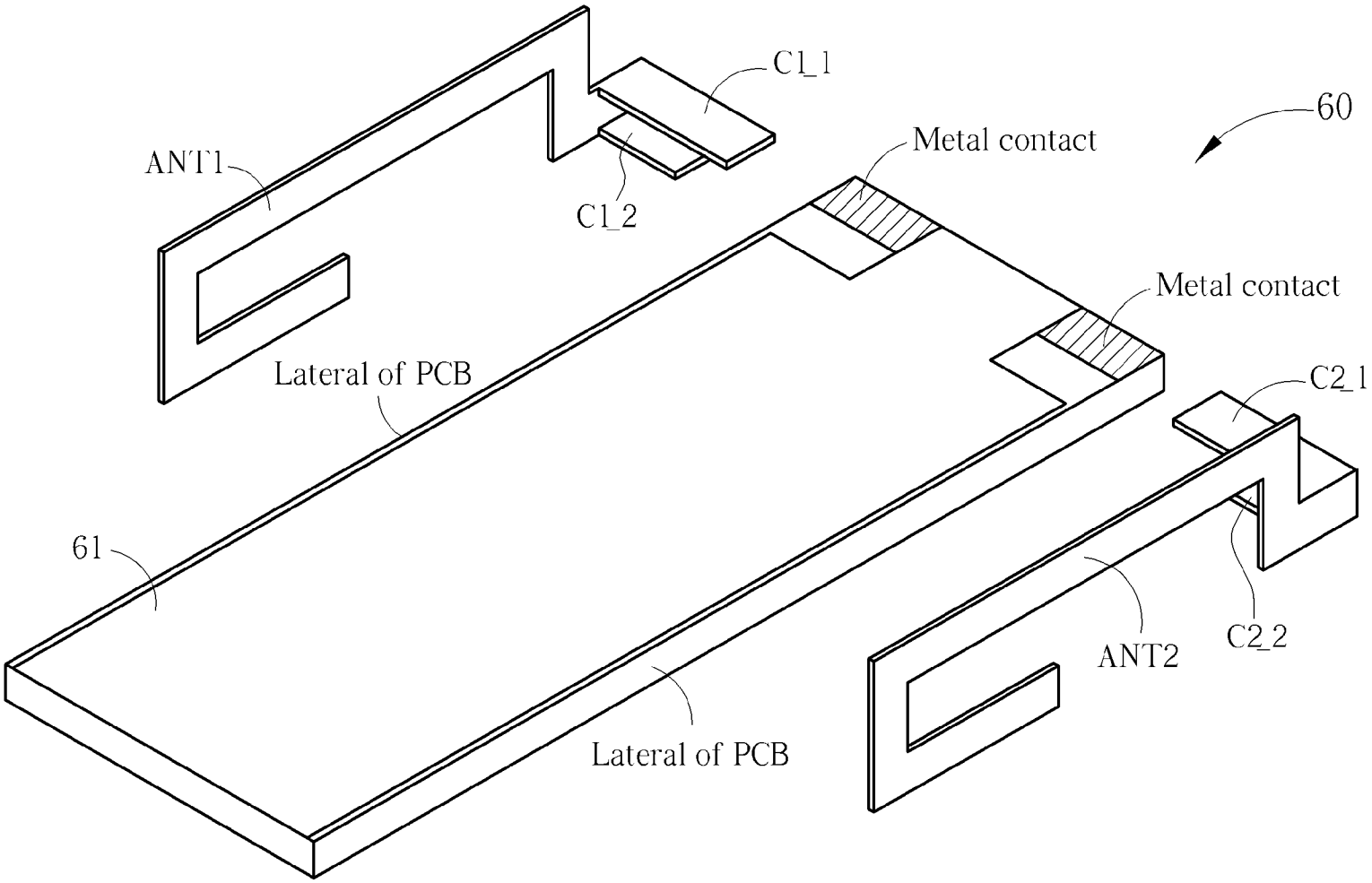
FIG. 6 is an illustration of an electronic device with an embedded three-dimensional antenna according to a preferred embodiment of the present invention.
Figure 7:
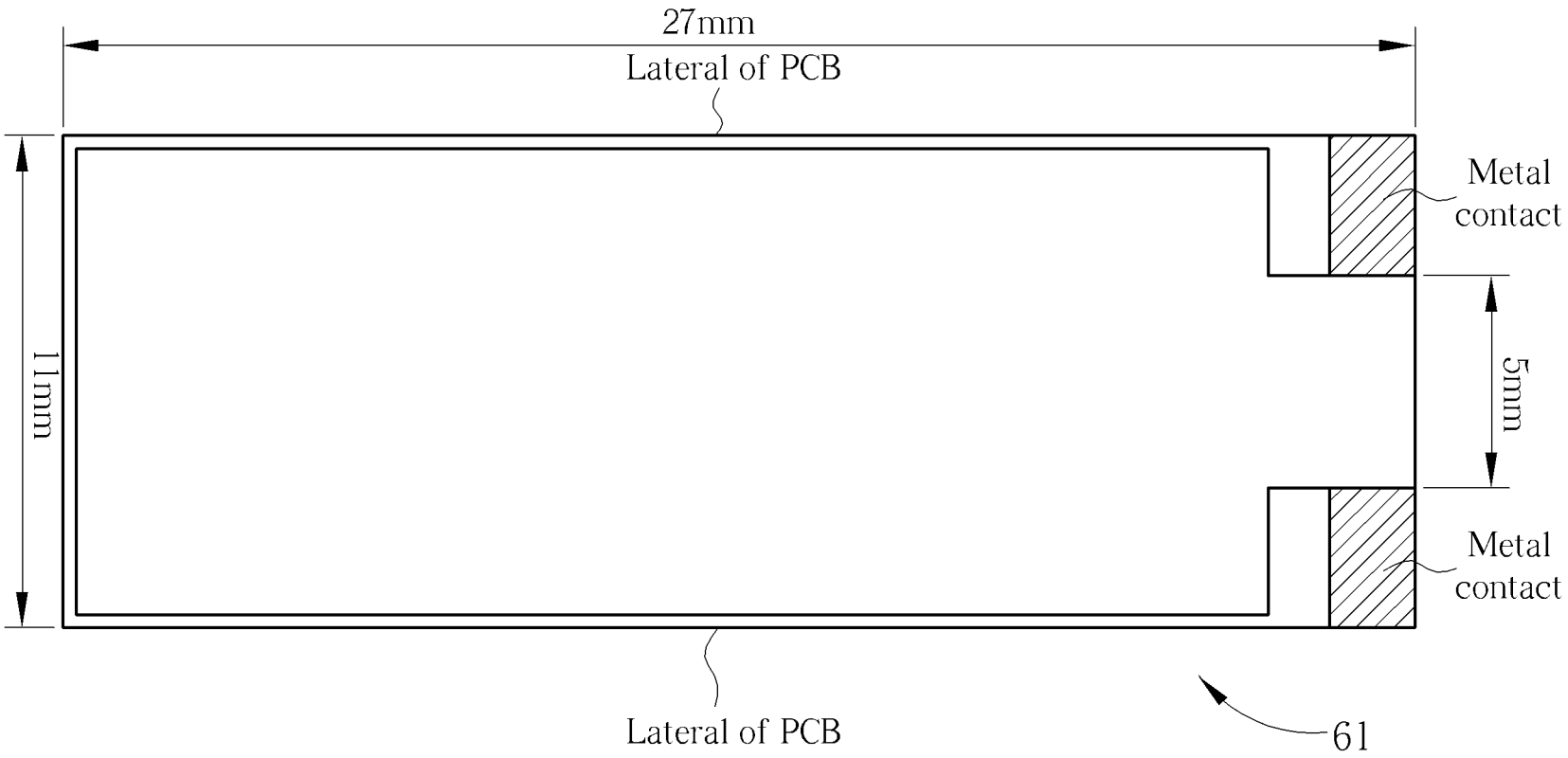
FIG. 7 is an illustration of a top view of a PCB in FIG. 6.
Figure 8:
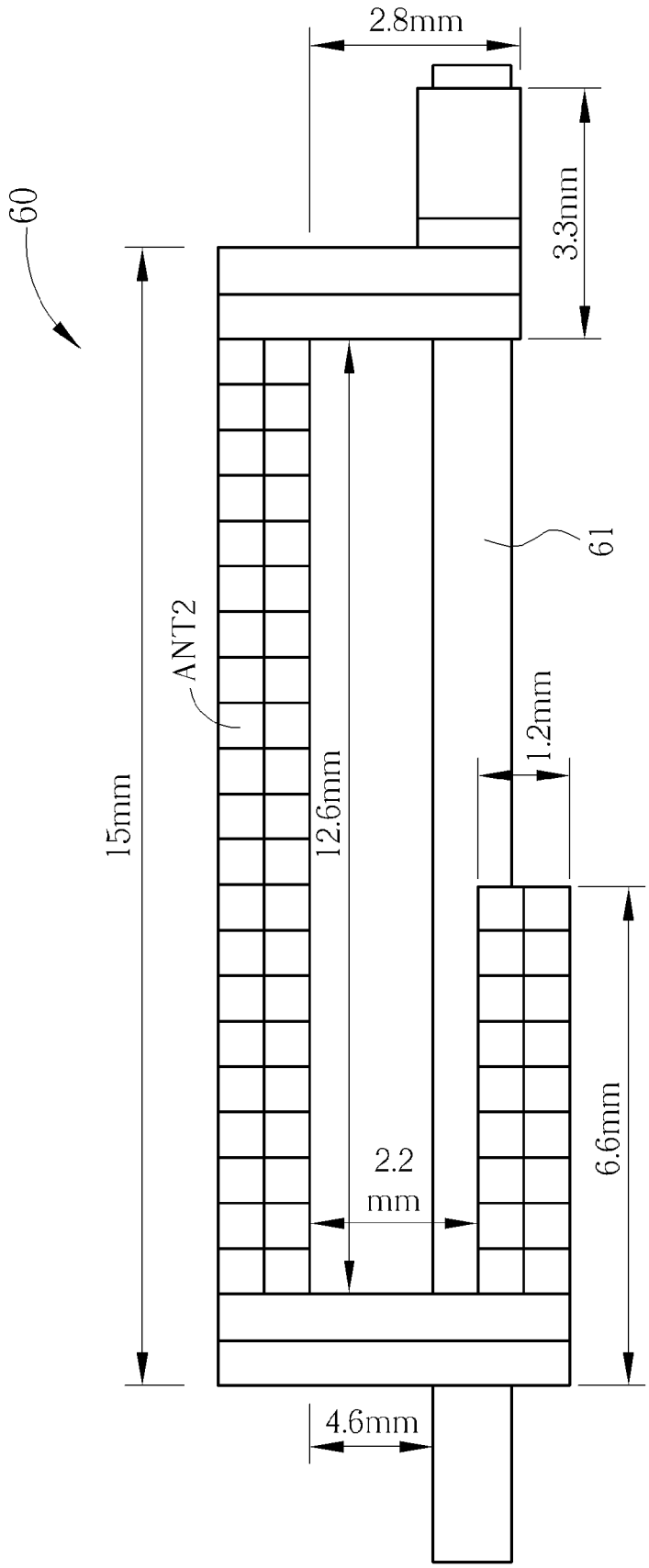
FIG. 8 is an illustration of a side view of the electronic device in FIG. 6.
Figure 9:
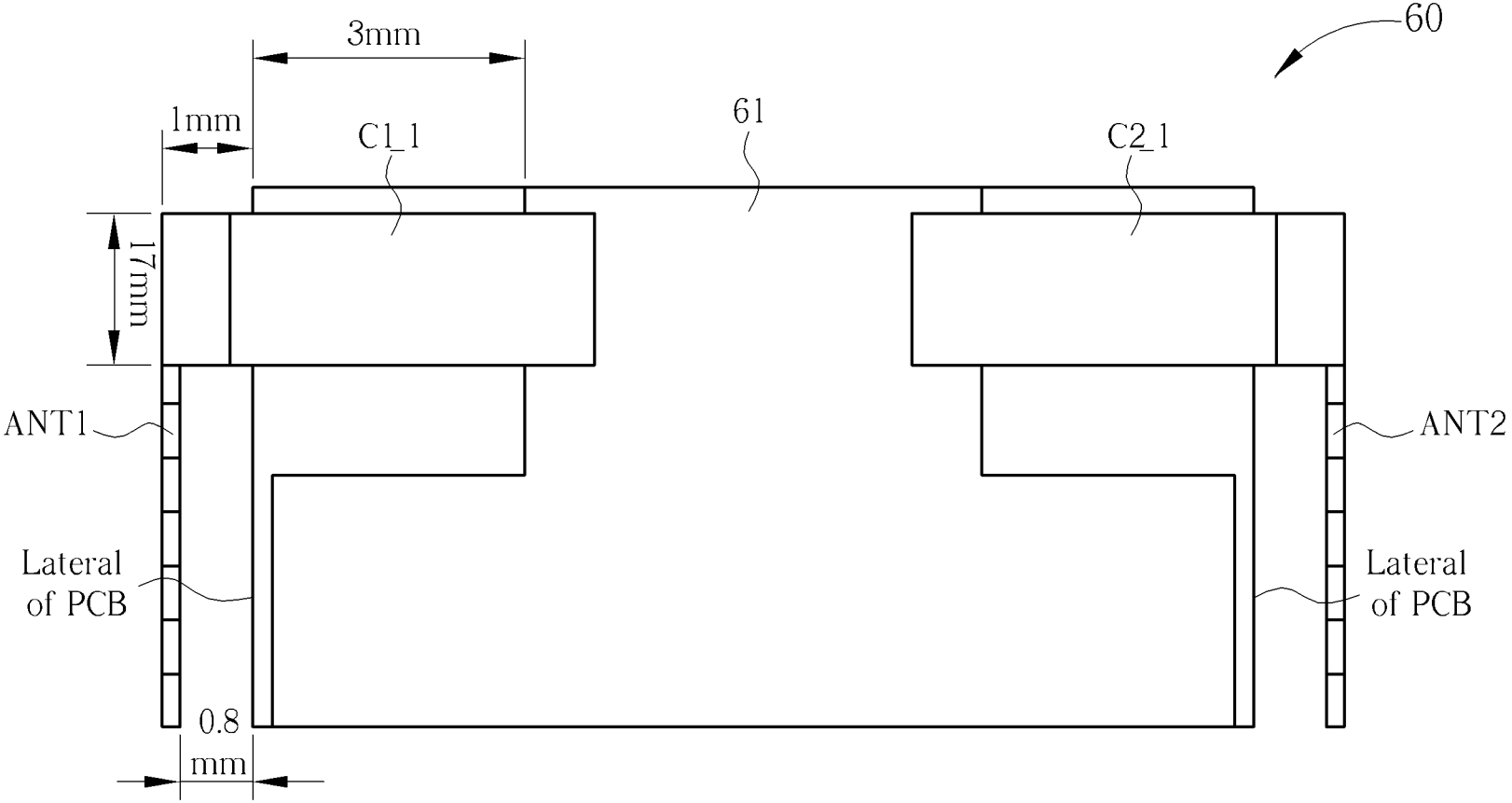
FIG. 9 and FIG. 10 are illustrations of a bottom view and a top view of the electronic device in FIG. 6, respectively.
Figure 10:
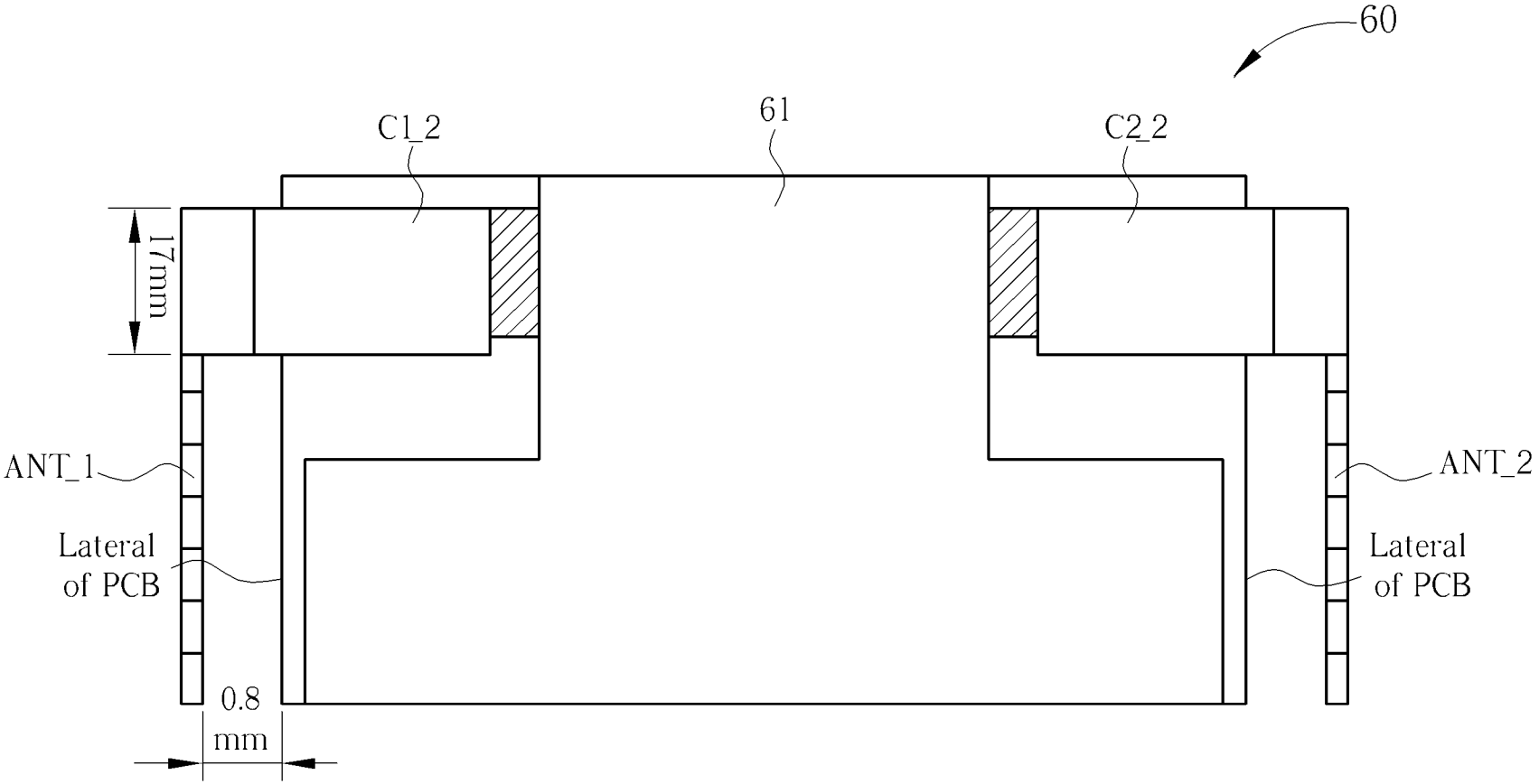

Please refer to FIG. 6, which is an illustration of an electronic device 60 with an embedded three-dimensional antenna according to a preferred embodiment of the present invention. As shown in FIG. 6, the electronic device 60 includes a PCB 61 and embedded three-dimensional antennas ANT1 and ANT2. The embedded three-dimensional antennas ANT1 and ANT2 can be two symmetric antennas made from a same metal die cut, or two antennas with distinct characteristics. In this embodiment, the embedded three-dimensional antennas ANT1 and ANT2 are designed as planar inverted-F antennas (PIFAs); and connection parts C1_1 and C1_2 of the antenna ANT1 and connection parts C2_1 and C2_2 of the antenna ANT2 can be used as feeding terminals and grounding terminals of the antennas ANT1 and ANT2, respectively, for coupling to corresponding metal contacts on the PCB 61. In this case, the dimensions of the electronic device 60 are shown in FIG. 7 to FIG. 10. FIG. 7 is an illustration of a top view of the PCB 61, FIG. 8 is an illustration of a side view of the electronic device 60, and FIG. 9 and FIG. 10 are illustrations of a bottom view and a top view of the electronic device 60, respectively.

Figure 11:
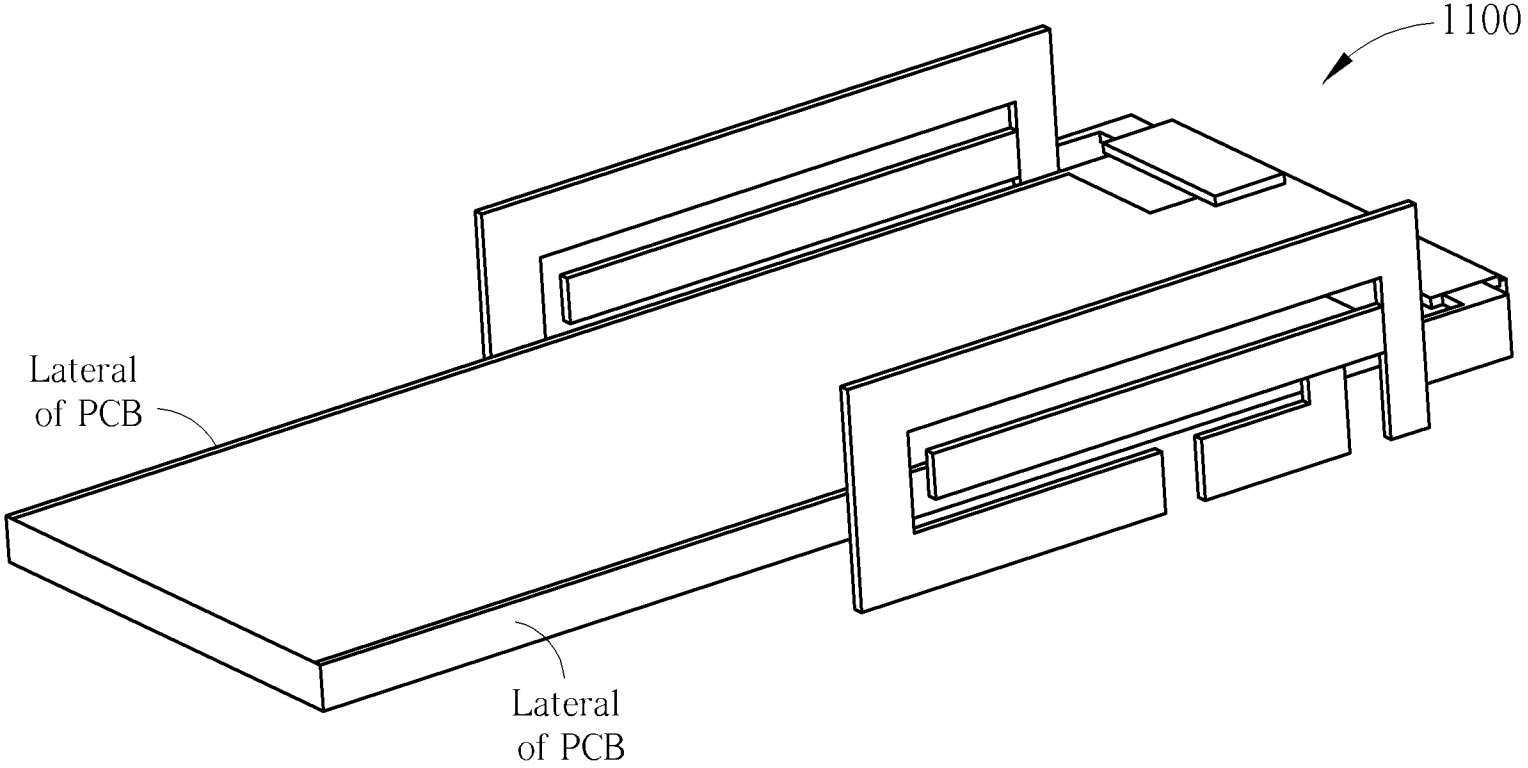
FIG. 11 and FIG. 12 are illustrations of electronic devices with an embedded three-dimensional antenna according to other embodiments of the present invention, respectively.
Figure 12:
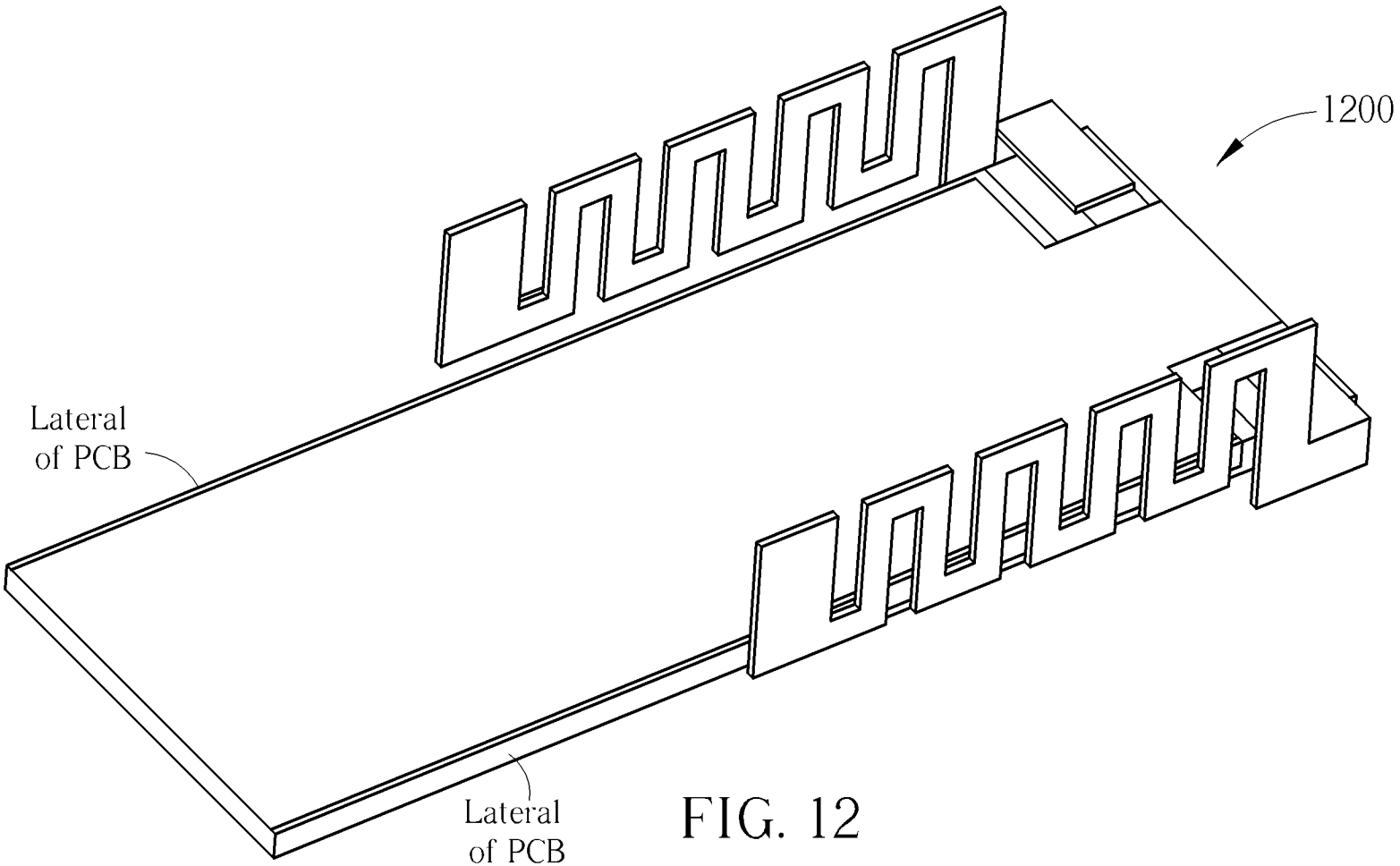

Accordingly, the present invention utilizes the clamping mechanism and the notch design formed by the connection element of the antenna to simplify the assembly process of the electronic device, so as to enhance the production yield, reduce the production cost and minimize the size of the PCB. For this case, only 3*3 mm2 of space is required on the PCB for assembling the PCB and the antenna, as shown in FIG. 9 and FIG. 10. Therefore, compared to conventional planar printed antennas, the present invention can significantly reduce the PCB size. Besides, the antenna is designed on the lateral of the PCB, so the SMT auto-insertion process and the soldering process can still be performed on the top and bottom sides of the PCB. Note that, the embedded three-dimensional antenna of the present invention can be any kinds of antennas, for example but not limited to, a monopole antenna, a dipole antenna and a PIFA, as long as the antenna has the said clamping mechanism. For example, please refer to FIG. 11 and FIG. 12. FIG. 11 and FIG. 12 are schematic diagrams of electronic devices 1100 and 1200 with an embedded three-dimensional antenna according to other embodiments of the present invention, respectively.

Of course, the above embodiments are just exemplary illustrations of the present invention, and those skilled in the art can certainly make appropriate modifications according to practical demands, which also belong to the scope of the present invention. Take FIG. 1 for example, the embedded three-dimensional antenna 12 can further form another clamping mechanism (not shown) at the other end of the radiation element 122 as an auxiliary of the connection element 124 to attach the antenna on the PCB 11; or each connection part of the connection element 124 can be formed by parallel short metal arms, and is not limited to one single metal element; or moreover, the radiation element 122 can be disposed on one side of the PCB 11 according to practical demands.

Figure 13:
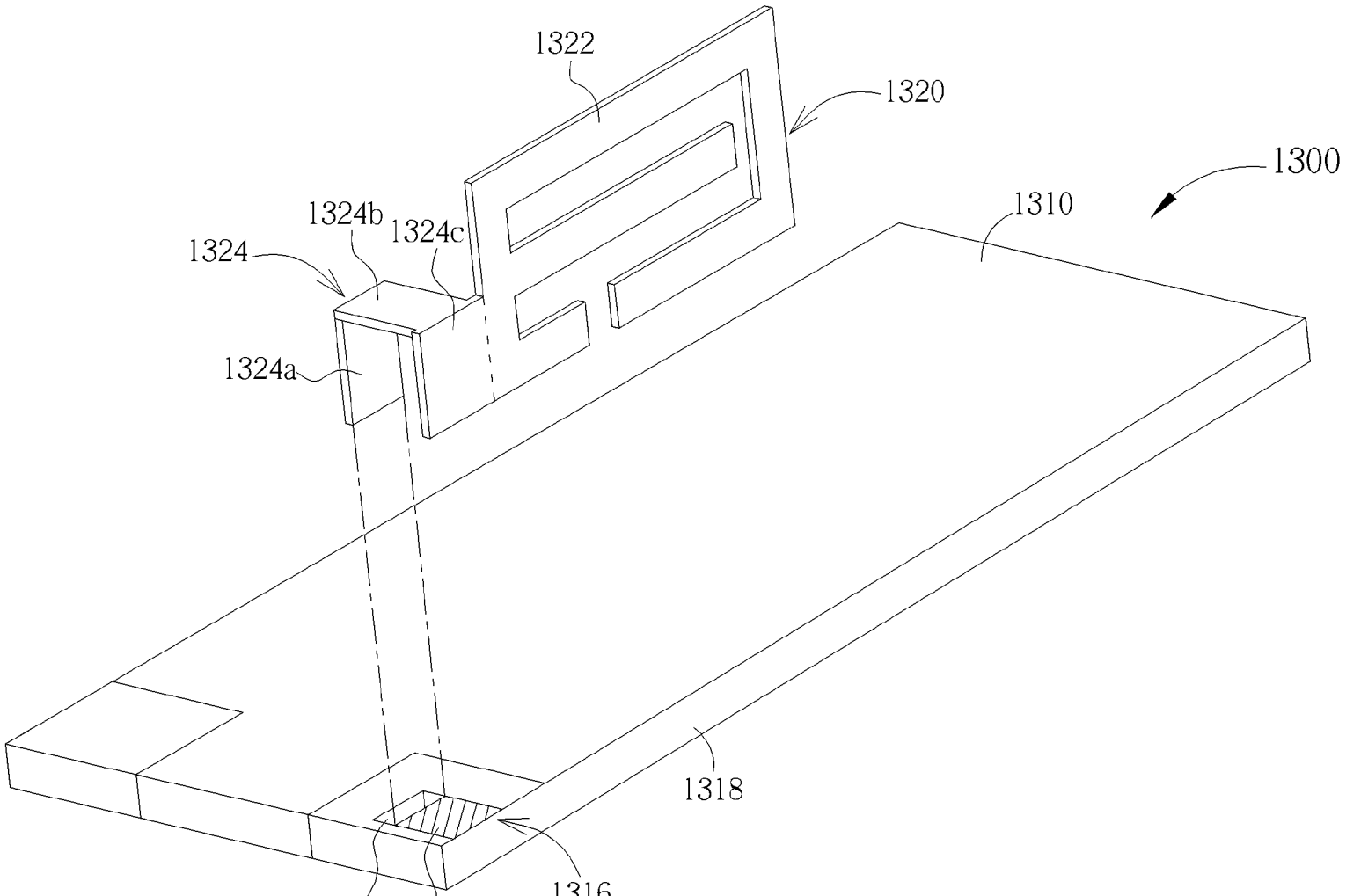
FIG. 13 is a schematic diagram of a electronic device with an embedded antenna according to an embodiment of the present invention.

In addition, please refer to FIG. 13, which is a schematic diagram of a electronic device 1300 with an embedded antenna according to an embodiment of the present invention. The electronic device 1300 can be a wireless electronic device such as a cell phone, a personal digital assistant (PDA) and a wireless USB dongle, and includes a Printed Circuit Board (PCB) 1310 and an embedded antenna 1320. The PCB 1310 is utilized for realizing functions of the electronic device 10, and may include a radio frequency (RF) circuit, a modulation/demodulation circuit, etc. depending on system requirement. The PCB 1310 includes a through hole 1312 and a metal contact 1314. The through hole 1312 and the metal contact 1314 form an antenna assembly area 1316. The embedded antenna 1320 includes a radiation element 1322 and a connection element 1324. The radiation element 1322 is utilized for transmitting RF signals generated by circuits on the PCB 1310 into air in different frequencies, and receiving RF signals with different frequencies from air. The connection element 1324 is utilized for connecting the radiation element 1322 and the PCB 1310, and forms a π (pi) shape mechanism. One leg of the π shape mechanism is connected with the radiation element 1322, and another leg of the π shape mechanism is inserted into the through hole 1312, such that the connection element 1324 is attached on the antenna assembly area 1316 of the PCB 1310 and the radiation element 1322 is parallel with a lateral 1318 of the PCB 1310.

In the embodiment of the present invention, the connection element 1324 includes three connection parts 1324*a*, 1324*b* and 1324*c*. The connection parts 1324*a* and 1324*c* form two legs of the π shape mechanism, respectively. The connection part 1324*a* is vertically inserted into the through hole 1312. The connection part 1324*b* is bended 90 degree to parallel with the PCB 1310, and is jointed with the metal contact 1314 by solder paste. The connection part 1324*c* is further bended 90 degree to parallel with the lateral 1318 of the PCB 1310, and is connected with the radiation element 1322. A contact area of the connection part 1324*b* and the PCB 1310 is able to support the whole weight of the embedded antenna 1320, and the connection part 1324*a* and the through hole 1312 are designed for keeping a relative position between the embedded antenna 1320 and the PCB 11. As a result, the embodiment of the present invention can utilize the π shape mechanism formed by the connection element 1324 to attach the embedded antenna 1320 on the PCB 1310. In this case, assembly processes of the embedded antenna 1320 can be integrated with automatic assembly processes, such as Surface Mount Technology (SMT) setting, such that manufacture processes of the electronic device 1300 are simplified and production cost is reduced.

Figure 14:
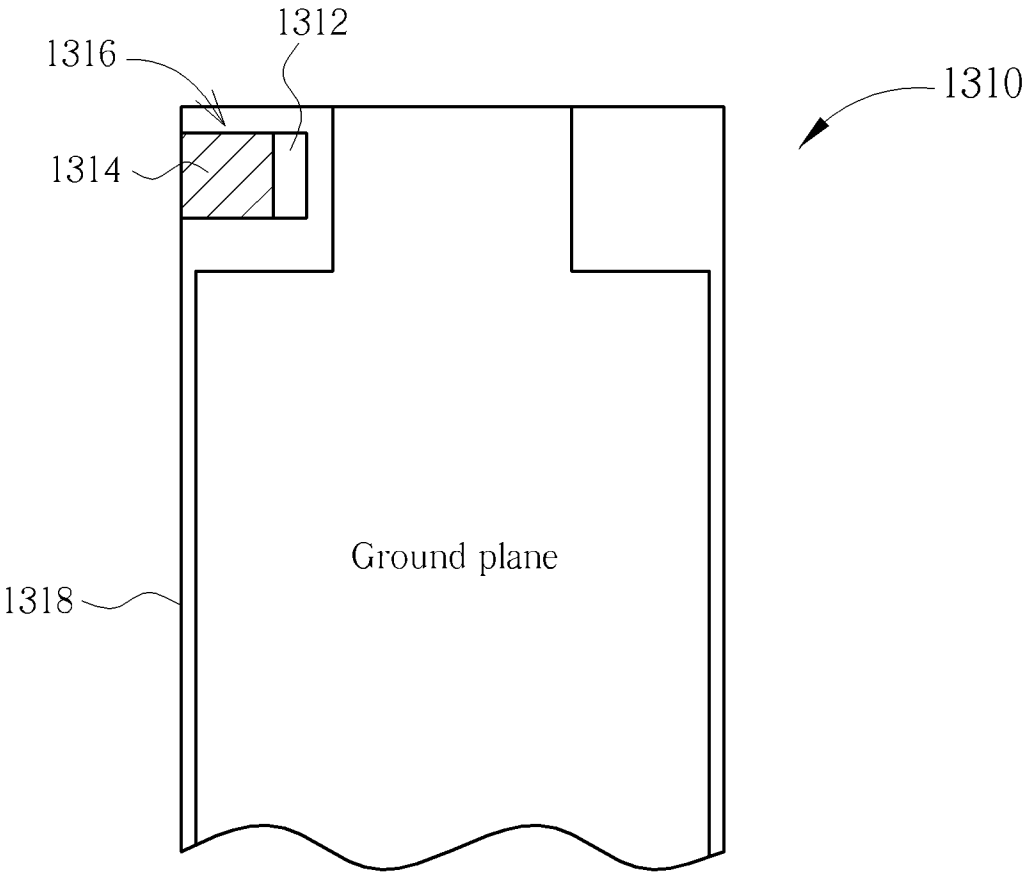
FIG. 14 is a top view diagram of the PCB shown in FIG. 12.

Please refer to FIG. 14, which is a top view diagram of the PCB 1310 shown in FIG. 13. A top layer and a bottom layer of the PCB 1310 are deposit area for electronic elements of the electronic device 1300, and a ground plane lies in one layer of the PCB 1310. The antenna assembly area 1316 is adjacent to the lateral 1318 of the PCB 1310, and includes the through hole 1312 and the metal contact 1314, as shown in FIG. 14. The through hole 1312 passes through the whole PCB 1310, and has an aperture approximating to a size of the connection part 1324*a* shown in FIG. 13, such that the connection part 1324*a* can be inserted into the through hole 1312 closely. The metal contact 1314 is formed on the surface of the PCB 11, and is a copper exposure area without mask during manufacture processes of the PCB 1310. The metal contact 1314 needs to be coated with solder paste during assembly processes of the embedded antenna 1320 for the following two reasons: One is to attach the metal contact 1314 with the connection part 1324*b*; and the other is to make the connection part 1324*a* be assembled with the through hole 1312 more closely by the solder paste when the solder paste on the metal contact 1314 flows into the through hole 1312. As for the assembly processes of the antenna and the PCB, please refer to the following descriptions.

First, after the PCB 1310 is brushed with the solder paste, a portion of the solder paste on the metal contact 1314 would flow into the through hole 1312, while other portion would remain on the metal contact 1314. In the embodiment of the present invention, the size of the connection part 1324*b* is properly designed to be sucked by a SMT nozzle. Therefore, the connection part 1324*a* can be inserted into the through hole 1312 by sucking the connection part 1324*b* with the SMT nozzle. Meanwhile, the connection part 1324*b* would be closely contacted with the solder paste on the metal contact 1314. After other elements are set on the PCB 1310, the PCB 1310 and the embedded antenna 1320 can be simultaneously sent into a reflow oven. Thus, the automatic assemble processes is completed when the PCB 1310 and the embedded antenna 1320 are cooled.

In other words, the embodiment of the present invention utilizes the π shape mechanism formed by the connection element 1324 to precisely attach the embedded antenna 1320 on the PCB 1310. As a result, the assembly processes of the embedded antenna 1320 can be integrated with the automatic assembly processes, such as the SMT setting. Compared to the prior art, the man-made errors owing to manual soldering can be avoid, and therefore, production yield can be significantly enhanced.

As can be seen from FIG. 13, all elements of the embedded antenna 1320 are practically formed by bending a single sheet metal. However, the one-piece embedded antenna is merely one embodiment of the embedded antenna 1320 for simplifying the manufacture processes. In other embodiments, the embedded antenna 1320 can also be formed by assembling multiple sheet metals. Besides, the embedded antenna can be any kind of antennas, for example but not limited to, a monopole antenna, a dipole antenna, a Planer Inverted F Antenna (PIFA) and a slot antenna. Those antenna designs all belong to the scope of the present invention as long as the π shape attaching mechanism is included.

Figure 15:
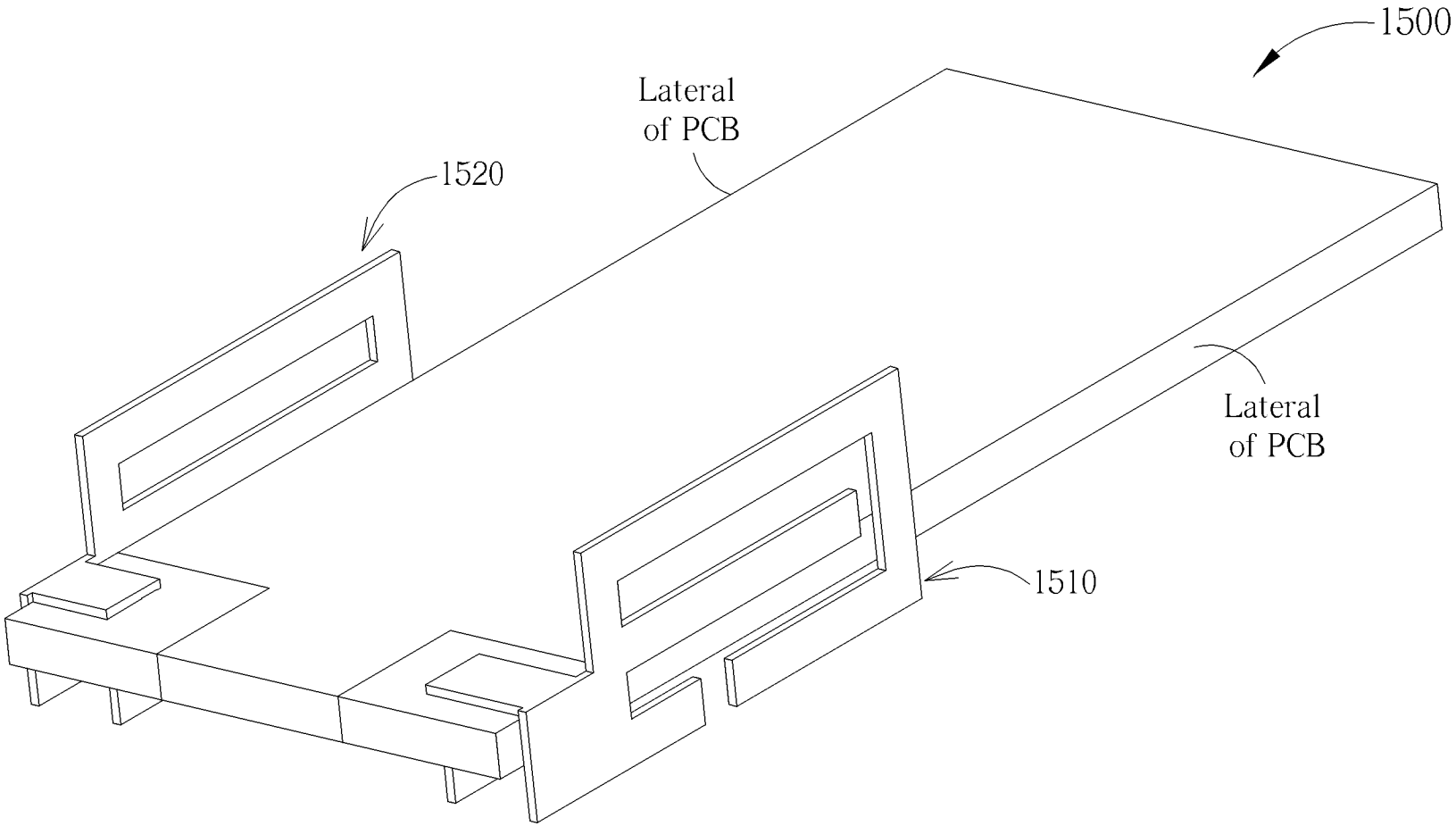
FIG. 15 to FIG. 17 are schematic diagrams of a electronic device with embedded antennas according to other embodiments of the present invention.

On the other hand, the embedded antenna amount is not specifically limited in the present invention, and can be only one or more than two according to practical requirements. For example, please refer to FIG. 15, which is a schematic diagram of a electronic device 1500 with embedded antennas according to an embodiment of the present invention. For two-transceiver two-receiver (2T2R) application, the electronic device 20 includes two embedded antennas 1510 and 1520 formed on two sides of a PCB, respectively. Assembly processes of the embedded antennas 1510 and 1520 are similar to the embedded antenna 1320 shown in FIG. 13, and are not narrated herein. In addition, the two embedded antennas can be two symmetric antennas made from a same metal die cut, or two antennas with distinct characteristics while retaining the spirit of the present invention.

Figure 16:
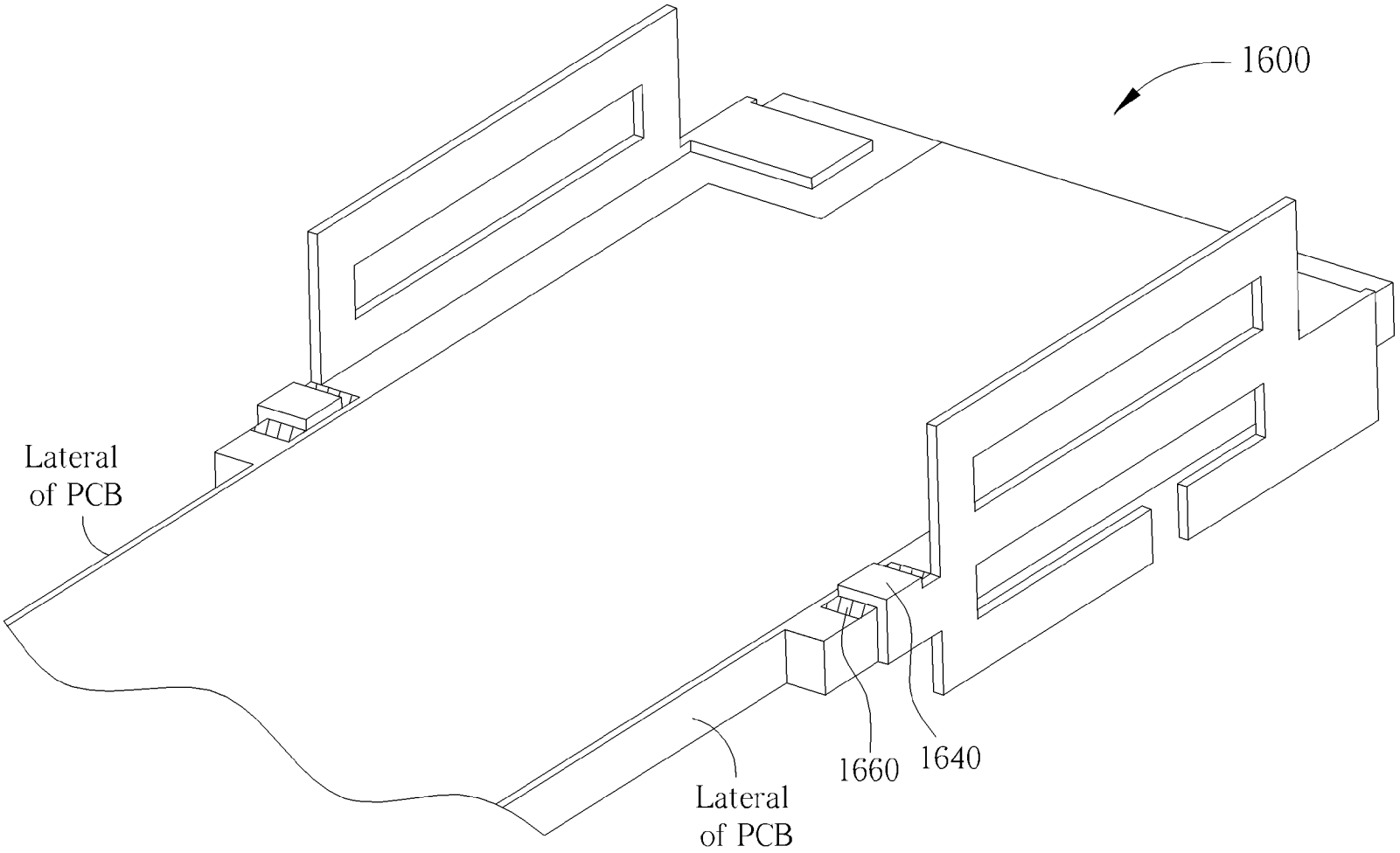
Figure 17:
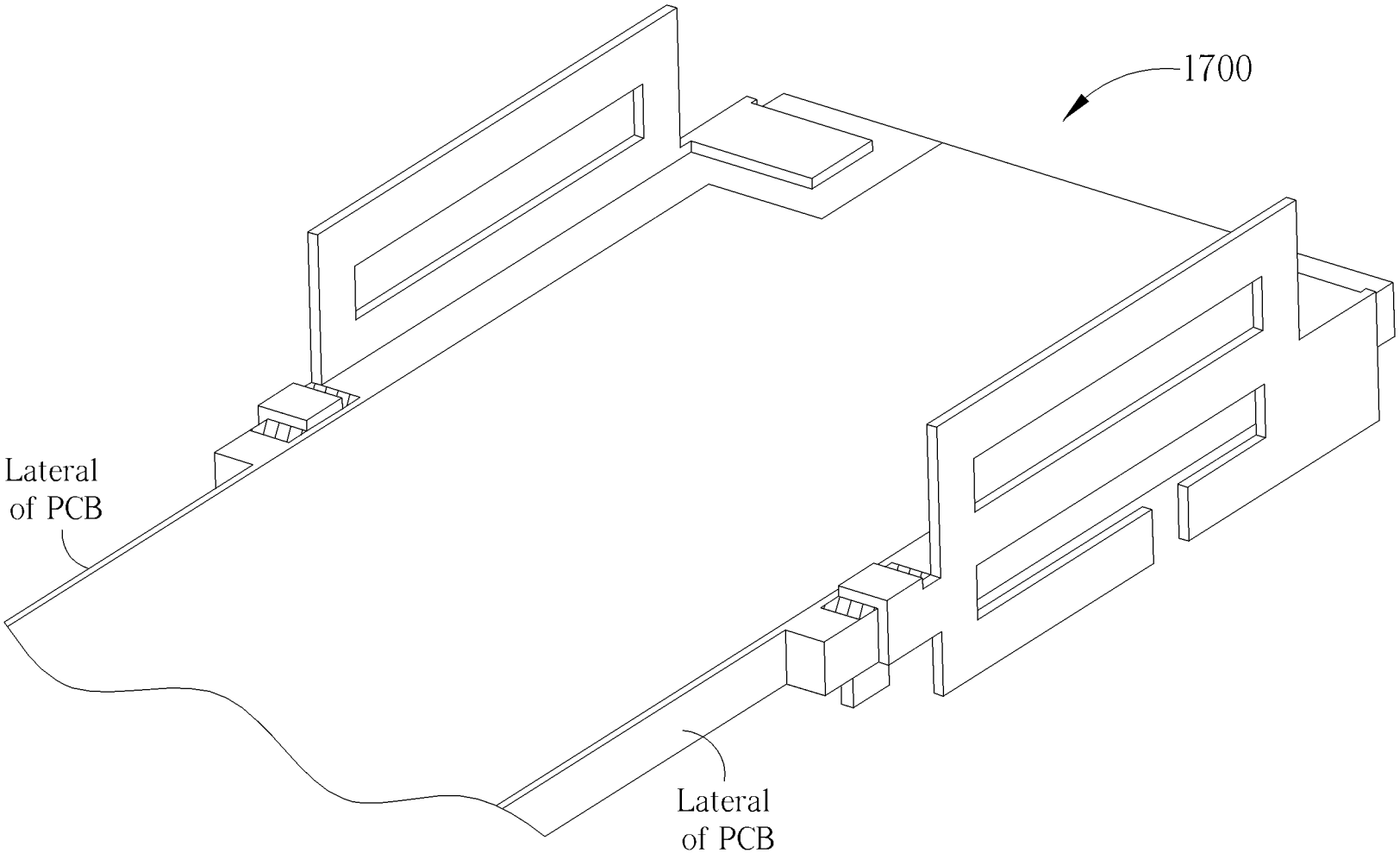

Please note that, the aforementioned embodiments are merely exemplary embodiments of the present invention. Those skilled in the art can make modifications or alterations according to practical requirement, which still belong to the scope of the present invention. For example, each embedded antenna can include additional attaching mechanisms, which acts as auxiliaries of the π shape mechanism to attach the antenna on the PCB. Please refer to FIG. 16 and FIG. 17, which are schematic diagrams of electronic devices 1600 and 1700 with embedded antennas according to other embodiments of the present invention, respectively. As shown in FIG. 16, each embedded antenna further includes an additional metal connection element 1640, while the PCB includes a corresponding metal contact 1660. In this case, the metal contact 1660 can be seen as another antenna assembly area on the PCB. Through solder paste and SMT setting, the connection element 1640 can be jointed with the corresponding metal contact 1660 on the PCB, such that the embedded antennas are assembled with the PCB more closely and precisely. Besides, if there is extra space on the PCB, the additional connection element can also be designed as a π shape mechanism, as shown in FIG. 17.

Furthermore, in the above embodiments, the connection element can not only be utilized as the attaching mechanism for the embedded antenna and the PCB, but the part coupled to the metal contact on the PCB can also be utilized as a feeding terminal or a grounding terminal of the embedded antenna, which is known by those skilled in the art and not narrated herein.

To sum up, by utilizing the π shape mechanism design, the embedded antenna can be performed by the automatic assembly processes such as the SMT setting and reflow together with the PCB, and thereby be precisely attached on the PCB. As a result, the present invention can avoid high assembly cost and antenna characteristic error due to the manual soldering process during the assembly processes of the conventional embedded antenna.

To sum up, in the electronic device of the present invention, one end of the embedded three-dimensional antenna is extended along the PCB and kept a proper distance from the PCB, while the other end is formed a clip-like clamping mechanism for clamping the PCB such that the embedded three-dimensional antenna can be attached on the PCB. Besides, by utilizing the π shape mechanism design, the embedded antenna can be performed by the automatic assembly processes such as the SMT setting and reflow together with the PCB, and thereby be precisely attached on the PCB. Therefore, the assembly process of the antenna can be simplified and integrated with the automatic assembly process, such as the SMT auto-insertion process, to reduce the production cost and avoid antenna characteristic error due to the manual soldering process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device with an embedded three-dimensional antenna, the electronic device comprising:

a printed circuit board (PCB); and an embedded three-dimensional antenna comprising:

a radiation element; and a connection element comprising a first connection part and a second connection part, the first and second connection parts, respectively coupled to the PCB, for transferring signals of the embedded three-dimensional antenna to the PCB;

wherein the first and second connection parts clamp the PCB such that the embedded three-dimensional antenna is attached on the PCB; wherein the connection element is formed at one end of the radiation element; and wherein the first and second connection parts respectively comprise a notch, for attaching a distance from the radiation element to the lateral of the PCB.

2. The electronic device of claim 1, wherein the embedded three-dimensional antenna further comprises a clamping element, formed at another end of the radiation element as an auxiliary of the connection element.

3. The electronic device of claim 1, wherein the first and second connection parts are a feeding terminal and a grounding terminal of the embedded three-dimensional antenna, respectively, and are coupled to metal contacts of the PCB.

4. The electronic device of claim 1, wherein tail ends of the first and second connection parts have an outward warped mechanism, respectively.

5. The electronic device of claim 1, wherein the radiation element is a bended metal sheet disposed on a lateral of the PCB.

6. The electronic device of claim 1, wherein the radiation element is a bended metal sheet disposed on one side of the PCB.

7. The electronic device of claim 1, wherein the embedded three-dimensional antenna is formed by a single metal sheet.

8. The electronic device of claim 1, wherein the embedded three-dimensional antenna is a planar inverted-F antenna (PIFA).

* * * * *